US005833118A

United States Patent [19]

Weiss

[11] Patent Number: 5,833,118

[45] Date of Patent: Nov. 10, 1998

[54] BATTERY DISPENSER BOX

[75] Inventor: James Weiss, Clemston, Fla.

[73] Assignee: Atico International USA, Inc., Ft. Lauderdale, Fla.

[21] Appl. No.: 898,182

[22] Filed: Jul. 22, 1997

Related U.S. Application Data

[63] Continuation-in-part of Ser. No. 807,419, Feb. 28, 1997.

[51] Int. Cl.[6] ..... B65D 5/72

[52] U.S. Cl. ..... 221/309; 221/305; 221/155; 229/122.1

[58] Field of Search ..... 221/155, 305, 221/307, 309; 229/122.1

[56] References Cited

U.S. PATENT DOCUMENTS

| | | | |
|---|---|---|---|
| 902,347 | 10/1908 | Tillinghast | 229/122.1 |
| 1,041,192 | 10/1912 | Tarbell | 211/155 |
| 1,898,056 | 2/1933 | Johnson | 229/122.1 |
| 1,973,867 | 9/1934 | Cook | 221/155 |
| 2,299,027 | 10/1942 | Novak | 229/122.1 |
| 3,300,115 | 1/1967 | Schauer | 221/305 |
| 3,332,594 | 7/1967 | De Capua | 221/309 |
| 4,739,922 | 4/1988 | Zimmermann | 229/122.1 |
| 5,460,322 | 10/1995 | Carlson et al. | 229/122.1 |

*Primary Examiner*—William E. Terrell
*Assistant Examiner*—Patrick Mackey
*Attorney, Agent, or Firm*—Cobrin & Gittes

[57] ABSTRACT

A battery dispenser that includes a container that has a face. The face has two edges that extend between sidewalls and between which is defined an aperture. The aperture may be of variable dimension such that a spacing between the two edges at one location is smaller than a diameter of the battery contained within the container. By concentrating manual forces at one of the edges, however, that one edge flexes to permit manual removal of the battery by grasping the ends of the battery via recess openings in the sidewalls that are adjacent to and in communication with the apertures. The sidewalls may each have a slot to permit viewing of the contents of the package.

4 Claims, 5 Drawing Sheets

BATTERY DISPENSER BOX

CROSS REFERENCE TO COPENDING PATENT APPLICATIONS

This is a continuation-in-part of U.S. Ser. No. 08/807,419, filed Feb. 28, 1997.

BACKGROUND OF THE INVENTION

1. Field of the Invention

The present invention relates to a package that dispenses batteries one at a time.

2. Discussion of Related Art

Batteries that are AA or AAA are typically packaged by enclosing them in a molded plastic with cardboard backing. Accessing the batteries requires creating an opening large enough to take out the batteries and may result in destruction of the backing, plastic or both. The result is a torn package that, if tilted, allows the batteries to fall out. If only some of the batteries need be used at a given time by the consumer, the torn package makes a poor storage depository for the remaining batteries because of the risk of them falling out if the torn package is turned over.

In an effort to provide a battery package that dispensed the batteries one at a time and yet prevented the batteries from falling out if the package is tilted, the present inventor conceived of the subject matter of U.S. Ser. No. 08/807,419. The inventor now proposes that the number of batteries remaining in the package become known to the user prior to dispensement by allowing the user to see through an opening in the package and count how many batteries are left.

SUMMARY OF THE INVENTION

One aspect of the invention relates to a battery dispenser that includes a container that has a face. The face has two edges that extend between sidewalls and between which is defined an aperture. The aperture may be of variable dimension such that a spacing between the two edges at one location is smaller than a diameter of the battery contained within the container. The sidewalls each have a recess that defines the ends of the aperture. One or both sidewalls may have a slot that extends a majority of a distance between the recess and a top edge of the box to allow one to see the contents of the package. This slot is dimensioned so that the batteries can not fit through the slot itself.

By concentrating manual forces at one of the edges, however, that one edge flexes to permit manual removal of the battery by grasping the ends of the battery via recess openings in the sidewalls that are adjacent to and in communication with the aperture. Preferably, the two edges are each curved with the widest spacing between the two edges being at the sides and the smallest spacing between the two edges being at the center.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
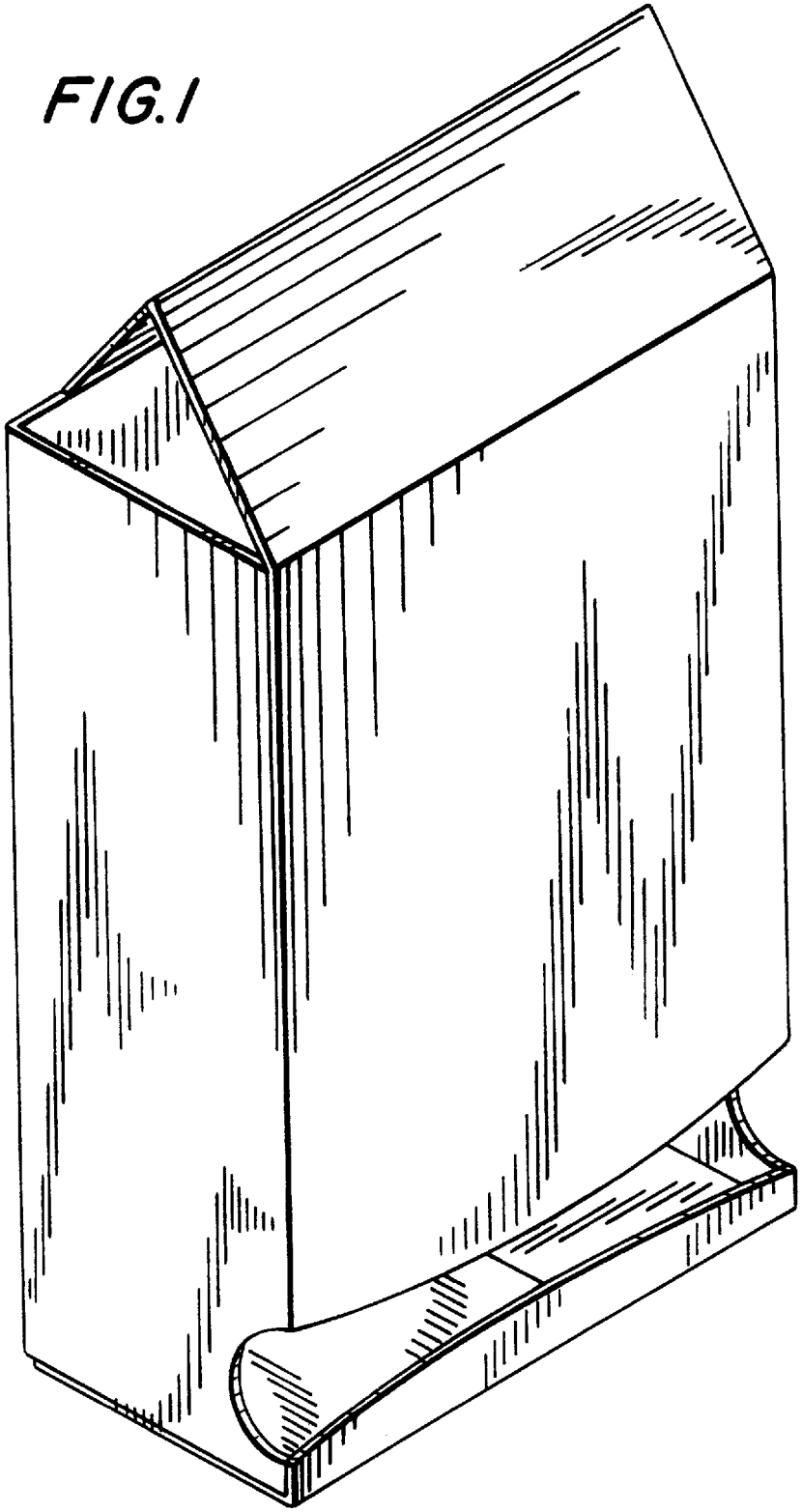
FIG. 1 is a perspective view of the battery dispenser in accordance with the invention.
Figure 2:
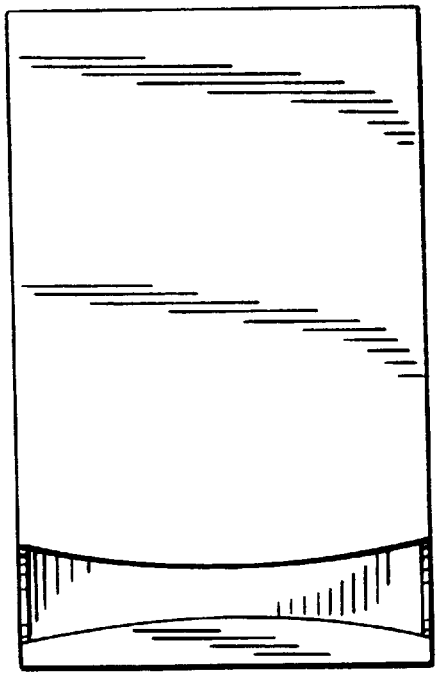
FIG. 2 is a front view thereof.
Figure 3:
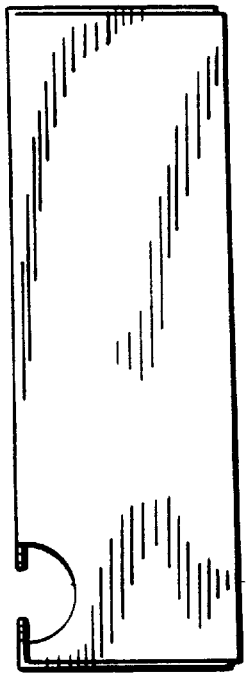
FIG. 3 is a left side view thereof the is identical/symmetric to the right side view thereof.

FIGS. 1–5 show a dispenser 10 with a lid 12. A front face 14 has an aperture 16 running the full width of the face between two edges 18 and defining a semicircular curved shape at the adjoining side walls 20. Preferably, the two edges are curved so as to define a spacing at the sides that is larger than that at the center. Since these edges are free, they flex in response to the application of a concentration of manual forces against their edges. In the absence of such manual forces, the face has a natural tendency to bow or concavely curve and stay in that position.

The lid 12 is opened to insert AA or AAA batteries until the box is full. When a battery is wanted, one grasps the ends of the battery visible through the aperture through the recesses 22 in the sidewalls 20 and the battery is pulled through the aperture between the two edges 18 of the front face 14. The front face 14 flexes in response to a concentration of forces being applied to its curved edge to allow the battery to emerge from the container.

Figure 4:
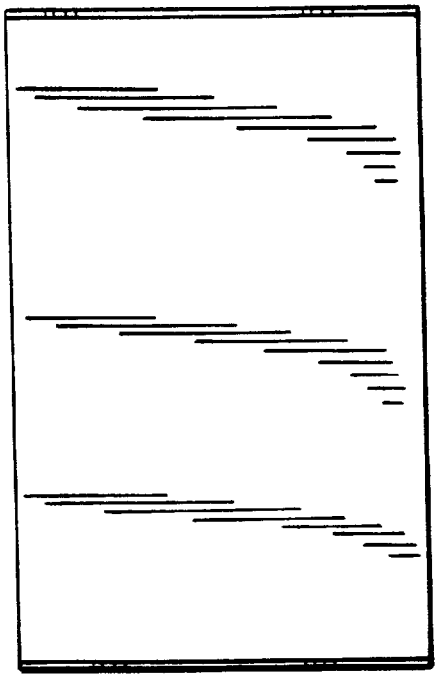
FIG. 4 is a back view thereof.
Figure 5:
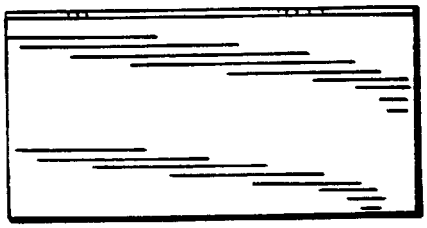
FIG. 5 is a top view thereof that is identical/symmetric to the bottom view thereof.

The sidewalls 20 each have an elongated aperture 25 spaced from the recesses 22. Each aperture 25 extends a majority of the length of the sidewalls and preferably centered. The widthwise dimension is too small to allow the batteries to be pulled through the aperture. However, the aperture allows one to see into the package to count the number of batteries contained within. Thus, one may know in advance how many batteries remain for dispensement. FIGS. 4 and 5 show the rear face 26 and bottom 28 respectively.

Figure 6:
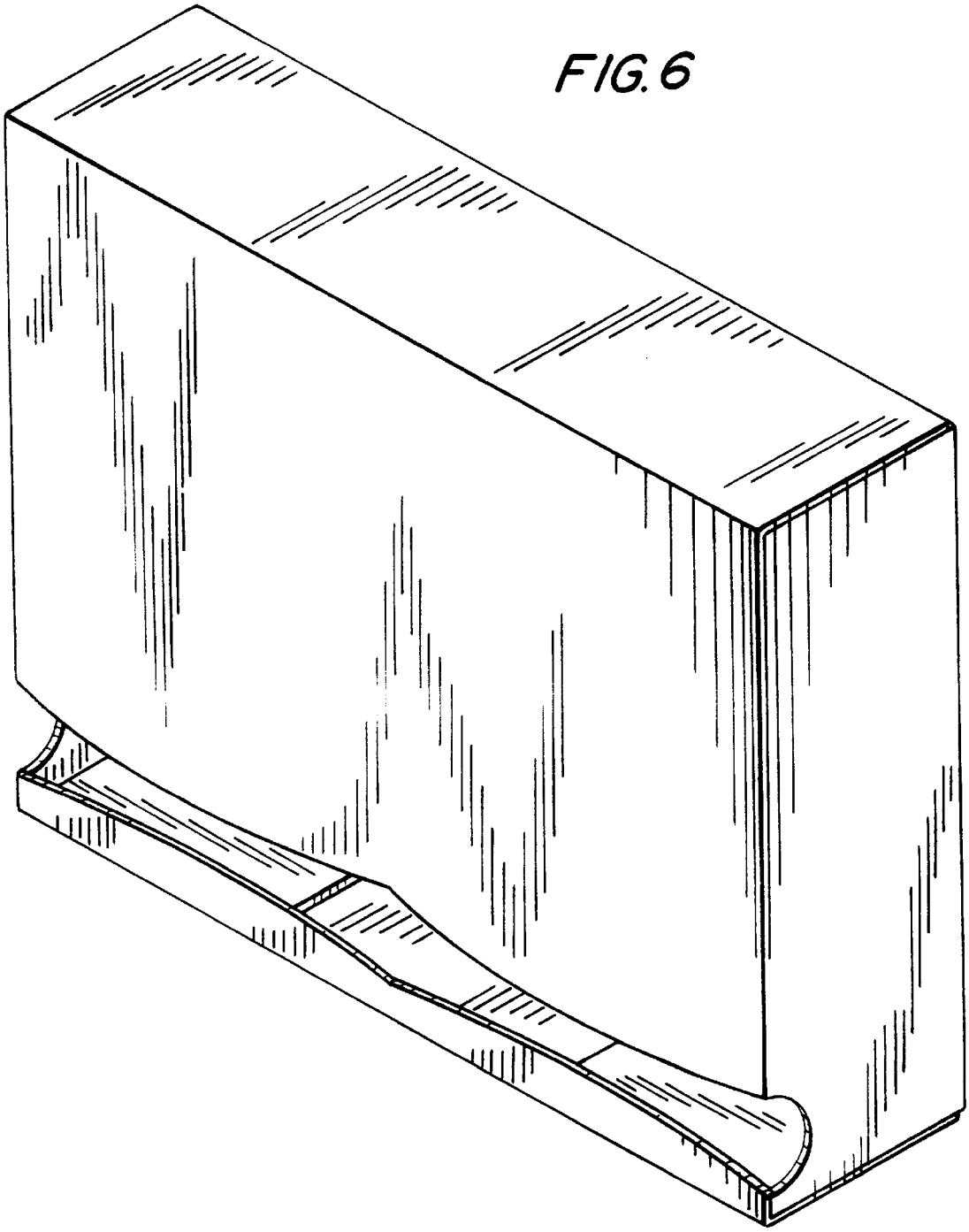
FIGS. 6–8 are perspective views of further embodiment.
Figure 7:
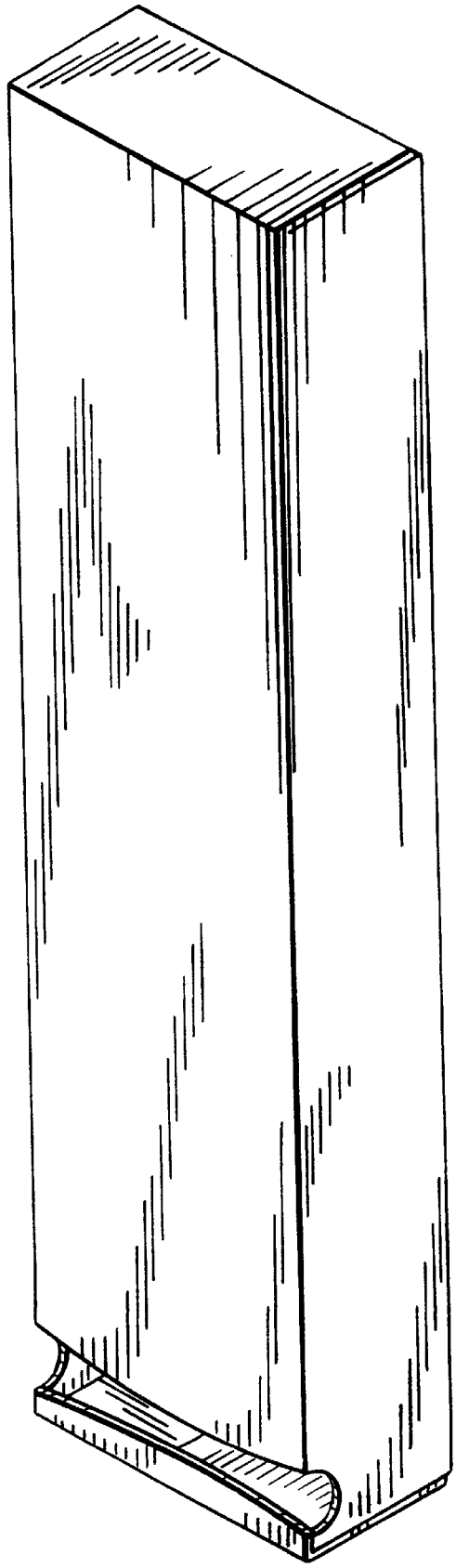
Figure 8:
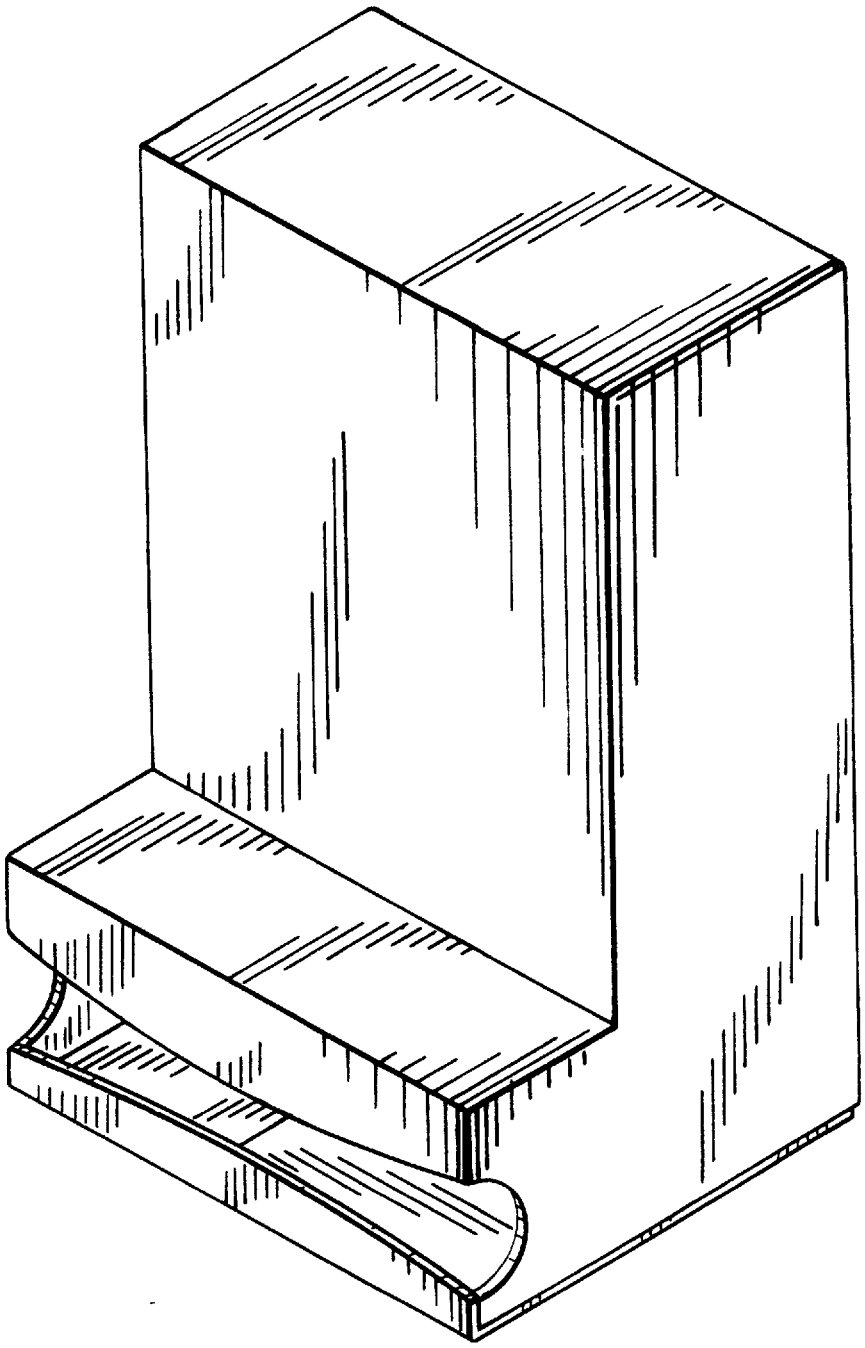

FIGS. 6 and 7 show further embodiments in which the width or height of the dispenser is doubled to accommodate additional batteries. In FIG. 6, the sidewalls 20 with respective aperture 25 may be identical to that of the embodiment of FIGS. 1–5, but the front face 30 is wider than the front face 14 of the embodiment of FIGS. 1–5. In FIG. 7, the sidewalls 32 are taller than those of the embodiment of FIGS. 1–5 and the front face 34 is taller as well. FIG. 8 shows the dispenser having an L-shaped sidewalls 36 to accommodate the bulk of the batteries towards the back away from the dispenser aperture. The aperture 25 in the FIG. 8 embodiment may be identical to that in the embodiment of FIGS. 1–5 or be L-shaped as well so as to have a horizontal leg that extends toward the recess 22.

The embodiments of FIGS. 1–8 may use a conventional box that is simply cut to define the aperture 22 in the front and adjoining sidewalls 20. The bottom of the box need not be opened and so does not require its own lid.

In all the embodiments, the dispenser may be constructed of cardboard, wood, plastic, metal or any other sturdy material. If plastic, the dispenser may be transparent. As may be appreciate from the differences in the embodiments of FIGS. 1 and 7–9, the dispenser may be of any size, such as a 4-pack or 12-pack of batteries. Also, the lid 12 may be so attached to a different one of the top edges and thereby swing open about that edge instead.

Cellophane or another type of plastic wrap is wrapped around the container to prevent removal of the batteries while the container is on a store shelf or hanging from a display rod for purchase. By making the container or box itself transparent, however, the consumer and merchant can see at the time of purchase just how many batteries are within the container or box.

Although the slot 25 as shown in the drawings is preferably elongated and centered along each of the sidewalls, it may have any desired configuration that allows one to see into the package. In addition, it may instead be composed of a series of spaced apart circular openings each of a diameter equal to that of the widthwise dimension of the elongated slot 25. Such circular openings may be considered to constitute the slot within the meaning of the present application.

While the foregoing description and drawings represent the preferred embodiments of the present invention, it will be understood that various changes and modifications may be made without departing from the spirit and scope of the present invention.

What is claimed is:

1. A battery-filled container, comprising;

a plurality of batteries; and a box containing the batteries arranged in a stacked manner, the box having a top edge, a face, and sidewalls adjacent opposite sides of the face, the face having two edges each convexly curved and extending between the sidewalls and defining an aperture between the two edges, the sidewalls each having a recess adjacent to and in spatial communication with the aperture, the aperture defining a spacing between a portion of each of the two edges that is smaller in dimension than a diameter of any one of the batteries contained within the container, the face flexing in response to a concentration of manual forces being applied to at least one of said two edges so as to in effect widen said aperture to permit the batteries to emerge through the aperture one at a time, at least one of the sidewalls having a slot that is situated between the recess and the top edge of the box, the slot having a widthwise dimension that is smaller in size than a diameter of any of the batteries contained within the container to permit viewing of remaining ones of the batteries in the stacked manner through the slot.

2. A container as in claim 1, wherein said slot is elongated and extends a majority of a distance between said recess and said top edge.

3. A container as in claim 1, wherein said slot is spaced from said recess.

4. A container as in claim 1, wherein each of the batteries are either type AA or AAA.

* * * * *